US005195720A

United States Patent [19]

Nortier et al.

[11] Patent Number: 5,195,720

[45] Date of Patent: Mar. 23, 1993

[54] FLUSH VALVE COVER

[75] Inventors: Richard Nortier, Brookfield; John F. Whiteside, Franklin Park, both of Ill.

[73] Assignee: Sloan Valve Company, Franklin Park, Ill.

[21] Appl. No.: 916,707

[22] Filed: Jul. 22, 1992

[51] Int. Cl.[5] ..... F16R 31/40

[52] U.S. Cl. ..... 251/129.04; 137/382; 4/DIG. 3

[58] Field of Search ..... 251/129.04; 137/377, 137/382; 4/DIG. 3

[56] References Cited

U.S. PATENT DOCUMENTS

| | | | |
|---|---|---|---|
| 3,291,148 | 12/1966 | Sloan | 137/382 |
| 3,915,185 | 10/1975 | Sanner | 137/377 |
| 4,309,781 | 1/1982 | Lissau | 4/DIG. 3 X |
| 4,793,588 | 12/1988 | Laverty, Jr. | 251/30.03 |
| 4,826,129 | 5/1989 | Fong et al. | 251/129.04 |
| 4,915,347 | 4/1990 | Iqbal et al. | 251/129.04 X |
| 4,971,287 | 11/1990 | Shaw | 251/129.04 X |
| 5,033,715 | 7/1991 | Chiang et al. | 251/129.04 |
| 5,062,453 | 11/1991 | Saaoi et al. | 251/129.04 X |
| 5,080,324 | 1/1992 | Chi | 251/129.04 |

*Primary Examiner*—John Rivell

*Attorney, Agent, or Firm*—Kinzer, Plyer, Dorn, McEachran & Jambor

[57] ABSTRACT

A flush valve includes a body having a water inlet and a water outlet. There is an inner cover mounted on the body and with portions of the flush valve defines a chamber which is in communication with the flush valve inlet. A sensor for detecting the presence of an object adjacent the flush valve is mounted on the inner cover, as is an electrical circuit for causing operation of the flush valve. There is an outer cover which encloses the inner cover, sensor, and electrical circuit. The outer cover is formed of a plastic which will transmit radiation from the sensor whereby the sensor can detect the presence of an object adjacent the flush valve. The inner and outer cover have interfitting lugs which restrict relative rotation therebetween and provide a means for attaching the covers to the flush valve body through the use of a ring which applies a load only to the inner cover.

15 Claims, 2 Drawing Sheets

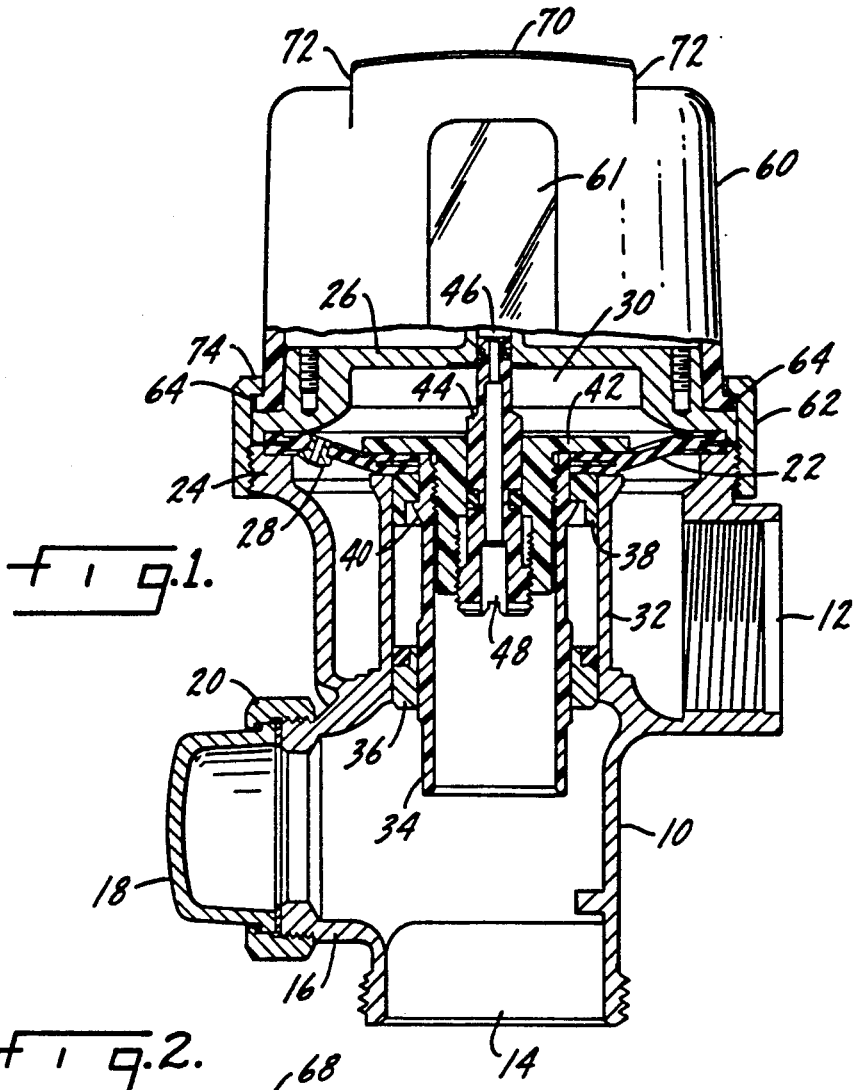
Fig.1.
Fig.2.
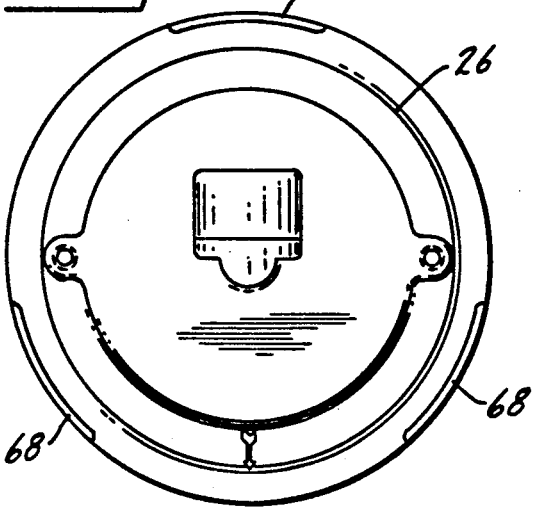
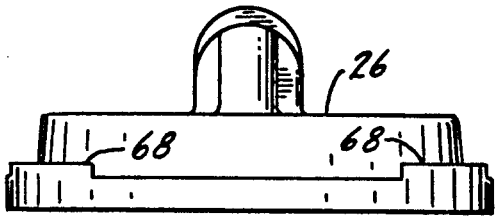
Fig.3.

FLUSH VALVE COVER

THE FIELD OF THE INVENTION

The present application relates to flush valves of the type commonly found in public washrooms and particularly to such flush valves which are sensor activated, for example by an infrared sensor such as shown in U. S. Pat. Nos. 4,309,781 and 4,793,588. The latter patent shows an infrared sensor which is battery operated. The present application is more particularly concerned with the covers for the flush valve, the manner in which the covers are mounted to the flush valve body, and the material of which the outer cover is made so as to transmit radiation in the infrared spectrum. The mechanical connection between the inner and outer covers and the manner in which such covers are mounted on the flush valve body are particularly directed to preventing vandalism and insuring the integrity of the outer cover.

SUMMARY OF THE INVENTION

The present invention relates to flush valves of the type generally found in public washrooms and in particular to improvements in such flush valves in the area of the covers which hold the electrical component for operating the flush valve.

A primary purpose of the invention is a flush valve of the type described utilizing an outer cover formed of a plastic material which will transmit and receive light in the infrared spectrum which is used in the sensing of an object adjacent the flush valve, which sensed object causes operation of the valve.

Another purpose is a flush valve construction utilizing an inner cover to mount the electrical components for operating the flush valve and an outer cover which encloses the electrical components and is formed of a material suitable for transmitting the outgoing and incoming signal for the sensor which is a part of the electrical package of the flush valve.

Another purpose is a flush valve as described in which the interfitting portions of the inner and outer covers are designed to retain the integrity of the outer cover and prevent vandalism.

Another purpose is a flush valve construction as described which may function to retrofit existing flush valves for electrical battery operation.

Another purpose is a flush valve construction as described utilizing a plastic outer cover which is formed of a material which is chemically resistant, but permits the passage of light rays in the infrared spectrum.

Another purpose is a flush valve outer cover as described, which includes the addition of a pigment in an amount sufficient to obscure the interior of the cover, but yet will permit the transmission of the incoming and outgoing signals for the sensor which is positioned within the cover.

Another purpose is a flush valve construction as described in which the inner and outer covers interfit in a manner to assure correct alignment of the outer cover with the sensor within.

Other purposes will appear in the ensuing specification, drawings and claims.

BRIEF DESCRIPTION OF THE DRAWINGS

The invention is illustrated diagrammatically in the following drawings wherein:

FIG. 1 is a section through the flush valve of the present invention;

FIG. 2 is a top view of the flush valve inner cover;

FIG. 3 is a side view of the inner cover;

DESCRIPTION OF THE PREFERRED EMBODIMENT

Figure 4:
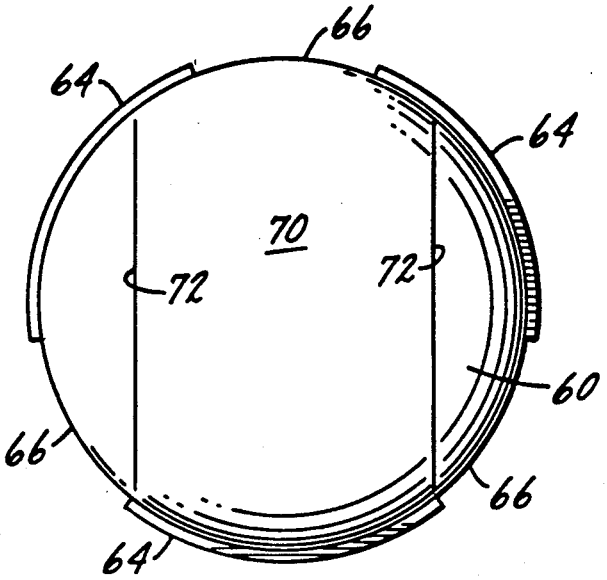
FIG. 4 is a top view of the flush valve outer cover.
Figure 5:
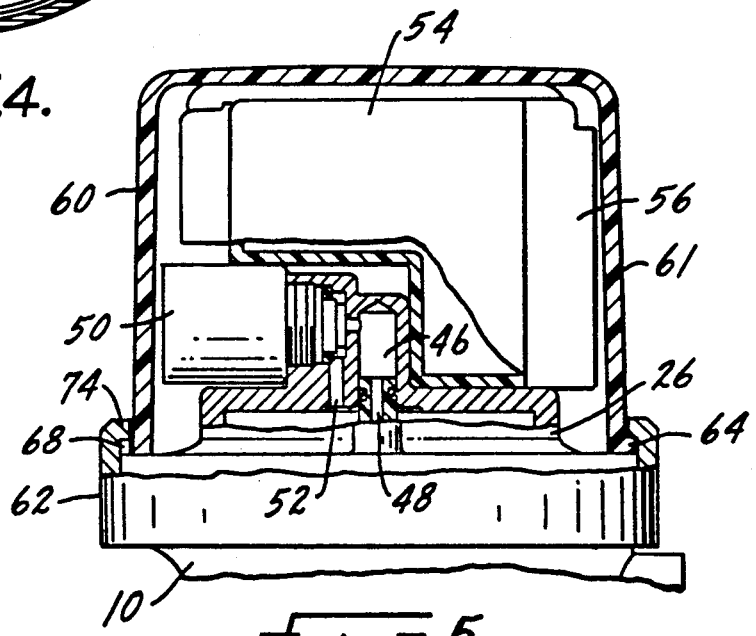
FIG. 5 is a section through the top portion of the valve taken at 90 degrees to FIG. 1.

The assignee of the present application, Sloan Valve Company, of Franklin Park, Ill., sells several types of flush valves for use in commercial washrooms to operate both urinals and water closets. Such valves may be manually operated or they may be operated through the use of an infrared sensor, the latter being sold by Sloan Valve Company under the trademark OPTIMA.

The present application is specifically concerned with a valve similar to the ROYAL flush valve, but which is battery powered and operated through the use of an infrared sensor. The construction shown and described may be sold as original equipment, or it may be sold as a conversion kit in which an existing valve of the ROYAL type may have its top cover removed and the cover and associated parts described herein placed on the existing valve structure which then provides a sensor controlled, battery powered flush valve which has no requirement for manual operation. The structure described has application in various other types of flush valves and should not be limited to the valves of Sloan Valve Company or its ROYAL flush valve.

The present invention is specifically concerned with the relationships between the inner and outer covers which house the batteries for operating the flush valve and the sensor for activating it and the manner in which these elements are attached to the flush valve body.

In FIG. 1 a flush valve body is indicated at 10 and may have an inlet opening 12, and a bottom directed outlet opening 14. There is a boss 16 at the left side of outlet 14 and normally this is the location of the manual handle. However, in the present instance, a cap 18 may close this opening and may be held in position by a lock ring 20.

The valve shown is of the ROYAL type and thus uses a diaphragm to control flow between the inlet and outlet. The diaphragm is indicated a 22 and is held at its periphery between a portion 24 of body 10 and the underside of an inner cover 26. The diaphragm has a bypass orifice 28 which is in communication with valve inlet 12 and which is used to fill the chamber 30 beneath inner cover 26 and above diaphragm 22.

The valve body includes a throat 32 within which is positioned a guide 34 centered in the throat by a flow control ring 36. A refill ring 38 is positioned at the upper end of guide 34 and is mounted on an outwardly extending shelf 40 on the guide. A piston disc 42 is threaded to the inside of guide 34 and is used to attach the assembly of the guide and refill ring to diaphragm 22. Thus, these elements all move in unison as the diaphragm moves between open and closed positions of the valve. The diaphragm subassembly is completed by a piston screw 44 which is threaded to the inside of piston disc 42 and extends upwardly into a bore 46 in inner cover 26. Piston screw 44 may have a passage 48 which is in communication with the valve outlet 14 for relief of chamber 30 when the valve is operated.

Mounted on top of inner cover 26 is a solenoid 50, the operation of which controls water flow from chamber 30 through a passage 52 in inner cover 26 and into bore 46 in the inner cover. Thus, the solenoid controls the venting of chamber 30 through passages 52, 48 and bore 46 to the outlet 14 of the flush valve.

Also mounted on top of upper cover 26 are batteries in housing 54 which power the solenoid and an infrared sensor in housing 56 which has a transmitter and receiver. The transmitter will emit infrared radiation and if there is an object nearby, such radiation will be reflected back to the receiver and such received radiation at the receiver will cause the batteries to power solenoid 50 to open the described passages to permit operation of the flush valve in a well known manner. The use of infrared sensors in this environment is old in the art and will not be described in detail. Reference is made to the above-mentioned U.S. patents.

There is an outer cover or dome 60 which encloses the electrical operating components of the flush valve. This dome is held onto the flush valve body and to inner cover 26 through the use of a locking ring 62. The material of dome 60 is important. Preferably, it is formed of a plastic which is highly resistant to the chemicals which may be found in washrooms and which may be used for cleaning purposes in washrooms. The material must also be highly impact resistant so as to resist attempts at vandalism. It has been found that polysulfone is a highly desirable plastic material for this purpose. The plastic dome 60 will be colored with a tint which will not impede or interfere with the transmission of infrared signals from the sensor, but will tend to mask or obscure the interior elements in the flush valve electrical control. It is preferred that a pigment be added to the polysulfone so that approximately 70 percent of visible light at all wave lengths will pass through the dome and approximately 30 percent will be impeded. A pigment made by Amoco bearing spec number BK1615 provides a not-quite-black, deep lavender dome which obscures the interior components, but yet permits transmission of a very substantial portion of light at all wave lengths.

In some applications, outer cover 60 may have a defined window 61 which is in alignment with sensor 56. This window will be made of the same material as other portions of the dome, but may be more highly polished in contrast with the somewhat matte finish of the remaining portions of the dome. An advantage of the window is it orients the dome relative to the sensor for specific purposes which will be described herein. Also, in a battery powered, sensor operated device as described, light emitting diodes are used at installation to assure that the device is functioning properly and subsequently to give a low battery power indication and the use of a polished translucent window is advantageous for maintenance personnel to see the flashing of the LED.

The lower edge of outer cover 60 has a series of uniformly spaced, outwardly directed lugs 64. There are gaps 66 between these lugs. Inner cover 26 has a series of upwardly directed, arcuately extending peripheral lugs 68 which will fit within gaps 66 when the outer cover is positioned upon the inner cover 26. Thus, these two elements are interlocked together. The location of lugs 64 relative to window 61 in outer cover 60 is such that the window will face the front of the flush valve, normally where a user, in the case of a urinal, would be present. There is a lug 64 directly in alignment with window 61. If vandalism is to occur, it normally would occur from the front of the flush valve and by having a lug 64 at that location, it is extremely difficult for a vandal to pry the outer cover off of the flush valve assembly.

Outer cover 60 has what may be best described as a strengthening beam 70 at the top thereof which again is in alignment with window 61 and which in effect provides a substantial increase in strength to the top of the cover, as contrasted with a cover which had a complete and uninterrupted dome. Beam 70 runs across the dome or outer cover, has side walls 72, which merge with adjoining portions of the outer cover. In addition to strengthening the cover itself, beam 70 has utility as a gripping surface for use in holding the outer cover when ring 62 is used to tighten the assembly down on the flush valve body. A wrench may be applied to the surfaces 72 of the outer cover or the surfaces may provide a convenient place for maintenance personnel to hand grip the cover when tightening the ring.

Ring 62 has an inwardly directed flange 74 which overlies lugs 64 on the outer cover and 68 on the inner cover. The inner cover will conventionally be formed of brass, whereas, the outer cover will be formed of plastic. The load from ring 62 to hold the covers onto the flush valve body is only applied to lugs 68. Thus, the vertical extent of lugs 68 will be slightly greater than the height of lugs 64 to the end that when ring 62 is tightened, the load from flange 74 is only applied to the lugs on the inner cover and not to the lugs on the outer cover.

When the flush valve shown and described is in use, the water pressure within chamber 30, which is at inlet pressure, may be as high as 400 psi and it is desired that this entire load on the inside of the cover be transmitted from the inner cover to the ring and that no load be applied to any portion of the plastic outer cover.

Whereas the preferred form of the invention has been shown and described herein, it should be realized that there may be many modifications, substitutions and alterations thereto.

The embodiments of the invention in which an exclusive property are claimed are defined as follows:

1. A flush valve including a body having a water inlet and a water outlet, an inner cover mounted on said body and defining a portion of a chamber which is in communication with said inlet, an outer cover enclosing said inner cover, interfitting means on said inner and outer covers preventing relative rotation therebetween, and a locking ring mounted on said body and having means thereon cooperating with said inner and outer cover interfitting means to attach said inner and outer covers to said body.

2. The flush valve of claim 1 further characterized in that said interfitting means includes outwardly directed, arcuately extending lugs on the periphery of said outer cover, and mating arcuately extending lugs on the periphery of said inner cover.

3. The flush valve of claim 2 further characterized in that the arcuately extending lugs on the periphery of said inner cover are directed toward said outer cover.

4. The flush valve of claim 3 further characterized in that the means on said locking ring cooperating with said lugs includes an inwardly directed flange overlying the inner and outer cover lugs.

5. The flush valve of claim 4 further characterized in that the mechanical load applied by said ring to hold said inner and outer covers to said body is only applied to said inner cover lugs.

6. The flush valve of claim 1 further characterized in that said outer cover is made of plastic which restricts in part the passage of light therethrough.

7. The flush valve of claim 6 further characterized in that said outer cover is made of polysulfone having a pigment added thereto which restricts the passage of light.

8. The flush valve of claim 6 further characterized by and including an infrared transmitter and receiver positioned within said outer cover for detecting the presence of a person using a toilet facility associated with the flush valve, said plastic material transmitting light waves in the infrared spectrum.

9. The flush valve of claim 6 further characterized in that said plastic outer cover has a generally opaque outer surface and a translucent window.

10. The flush valve of claim 9 further characterized by and including an infrared transmitter and emitter positioned within said outer cover for detecting the presence of an object adjacent said flush valve, said transmitter and emitter being generally in alignment with said translucent window.

11. The flush valve of claim 9 further characterized in that said interfitting means includes outwardly directed, arcuately extending lugs on the periphery of said outer cover, one of said lugs being aligned with and extending throughout the extent of said window.

12. The flush valve of claim 1 further characterized in that said outer cover has a generally central beam formed therein to add rigidity thereto.

13. A flush valve including a body having a water inlet and a water outlet, an inner cover mounted on said body, a sensor for detecting the presence of an object adjacent the flush valve mounted on said inner cover, said sensor transmitting and receiving light waves in a defined portion of the light spectrum, electrical means connected to said sensor for causing operation of said flush valve mounted on said inner cover, and an outer cover enclosing said inner cover, sensor and electrical means, said outer cover being formed of a plastic which passes said light waves.

14. The flush valve of claim 13 further characterized in that said sensor light waves are in the infrared spectrum, and said plastic is polysulfone.

15. The flush valve of claim 14 further characterized in that said plastic is at least in part opaque restricting the disclosure of the interior of said outer cover.

* * * * *